US008044865B2

(12) United States Patent
Chang

(10) Patent No.: US 8,044,865 B2
(45) Date of Patent: Oct. 25, 2011

(54) POLANAR MULTI-DIRECTIONAL ANTENNA

(75) Inventor: Ming-Wen Chang, Kowloon (HK)

(73) Assignee: San Wen (H.K.) International Co., Ltd., Kowloon (HK)

( * ) Notice: Subject to any disclaimer, the term of this patent is extended or adjusted under 35 U.S.C. 154(b) by 340 days.

(21) Appl. No.: 12/487,673

(22) Filed: Jun. 19, 2009

(65) Prior Publication Data

US 2010/0321254 A1 Dec. 23, 2010

(51) Int. Cl.
*H01Q 1/38* (2006.01)

(52) U.S. Cl. ..... 343/700 MS; 343/702; 343/850

(58) Field of Classification Search ..... 343/700 MS, 343/702, 850, 860
See application file for complete search history.

(56) References Cited

U.S. PATENT DOCUMENTS

| | | | | |
|---|---|---|---|---|
| 7,936,313 | B2 * | 5/2011 | Hockey et al. | 343/797 |
| 2006/0109192 | A1 * | 5/2006 | Weigand | 343/795 |
| 2006/0125697 | A1 * | 6/2006 | Hung et al. | 343/700 MS |

* cited by examiner

*Primary Examiner* — Hoanganh Le
(74) *Attorney, Agent, or Firm* — Leong C. Lei

(57) ABSTRACT

The planar multi-directional antenna mainly contains a flat casing and a double-layered circuit board housed inside the casing. The circuit board's two major sides are patterned in a symmetrical manner and traces are routed and extended along the circumference of the circuit board for producing multi-directional reception field pattern. A raised metallic plate is configured in the center on a first major side for avoiding the coupling effect from current converging in the center and for overcoming the dielectric loss by using air. A ferrite core is configured at the feeding terminal of the antenna as a means of impedance conversion. A SMD inductor and a SMD capacitor are provided on the other major side for increasing the antenna's capability of receiving signals of larger wavelength.

3 Claims, 5 Drawing Sheets

POLANAR MULTI-DIRECTIONAL ANTENNA

TECHNICAL FIELD OF THE INVENTION

The present invention generally relates to a planar multi-directional antenna, and especially relates to a planar multi-directional antenna having a raised metallic plate in the center of a circuit board so as to avoid the coupling effect from current converging in the center and to overcome the dielectric loss by using air

DESCRIPTION OF THE PRIOR ART

For receiving broadcast television programs, an outdoor or indoor antenna is a required device. For a conventional indoor antenna, as illustrated in FIG. 1, mainly contains a circuit board 1 having a circuit region 11 in a middle area and reception plates 111 at the lateral sides of the circuit region 1. Both the circuit region 11 and the reception plates 111 are printed on a major side of the circuit board 1. The reception plates 111 are for receiving UHF signals and, for VHF signals, copper strips 112 are provided and connected to the circuit region 11. As described, the conventional antenna has a very simple structure. However, the conventional antenna has to be raised and aimed at the signal source when used, which would take up significant space and wouldn't be quite appealing.

FIGS. 2 and 3 show the two sides of a double-layered circuit board 2 of another conventional indoor antenna which mainly utilizes contrapolarization and overlapped coupling to excite magnetic field. The antenna as such is capable of deployment in a planar manner and of multi-directional reception. However, the feed to the antenna has to go through microstrip line 21 and impedance conversion.

SUMMARY OF THE INVENTION

The present invention provides a planar multi-directional antenna which mainly contains a flat casing and a double-layered circuit board housed inside the casing. The circuit board's two major sides are patterned in a symmetrical manner and traces on both sides are routed and extended along the circumference of the circuit board for producing multi-directional reception field pattern. A raised metallic plate is configured in the center on a first major side for avoiding the coupling effect from current converging in the center and for overcoming the dielectric loss by using air. A ferrite core is configured at the feeding terminal of the antenna as a means of impedance conversion. A SMD inductor and a SMD capacitor are provided on the other major side for increasing the antenna's capability of receiving signals of larger wavelength.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
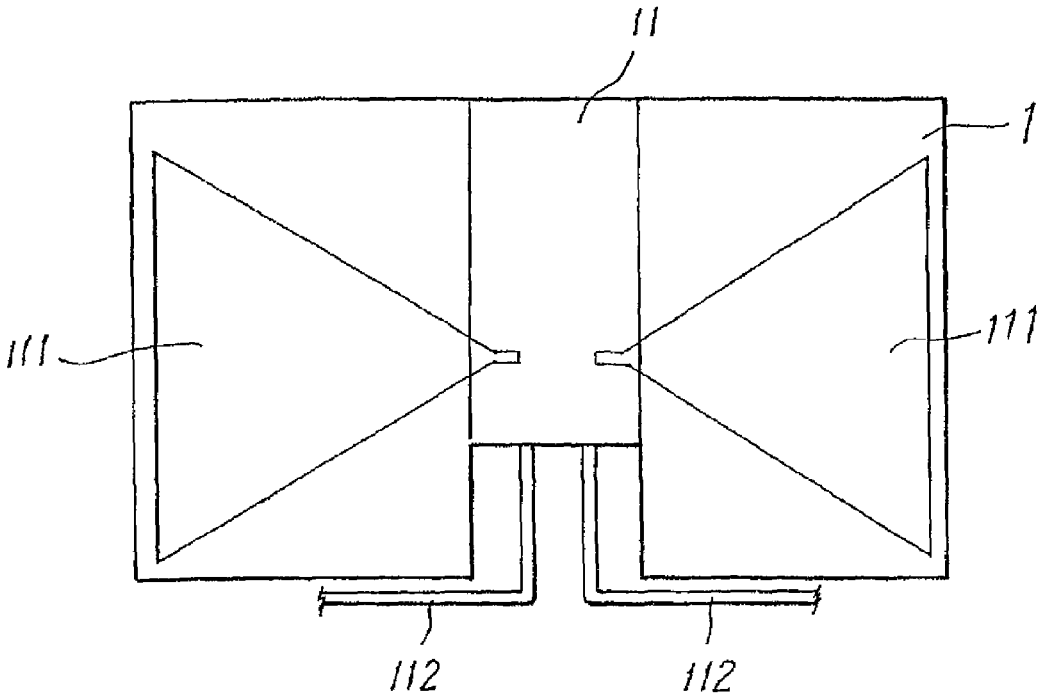
FIG. 1 is a schematic diagram showing a circuit board of conventional indoor antenna.
Figure 2:
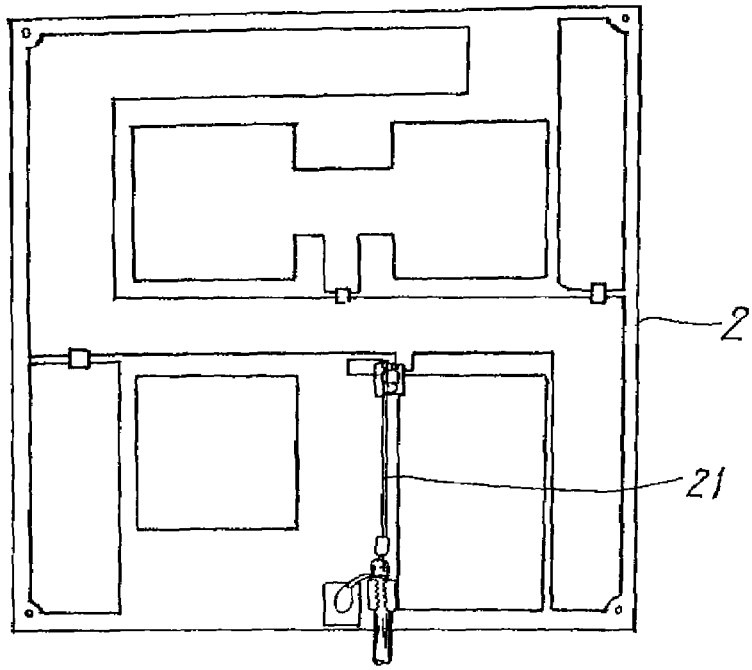
FIGS. 2 and 3 show the two major sides of a double-layered circuit board of another conventional indoor antenna.
Figure 3:
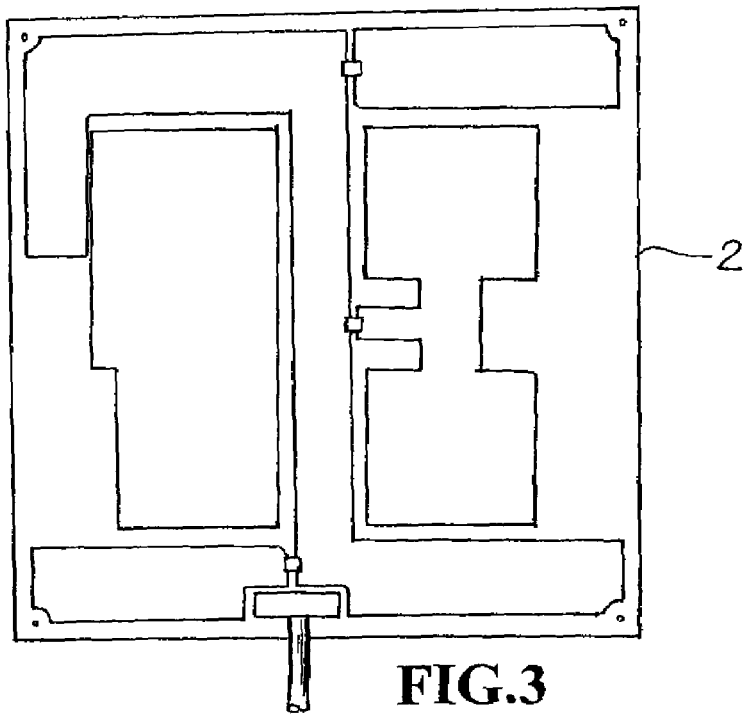
Figure 4:
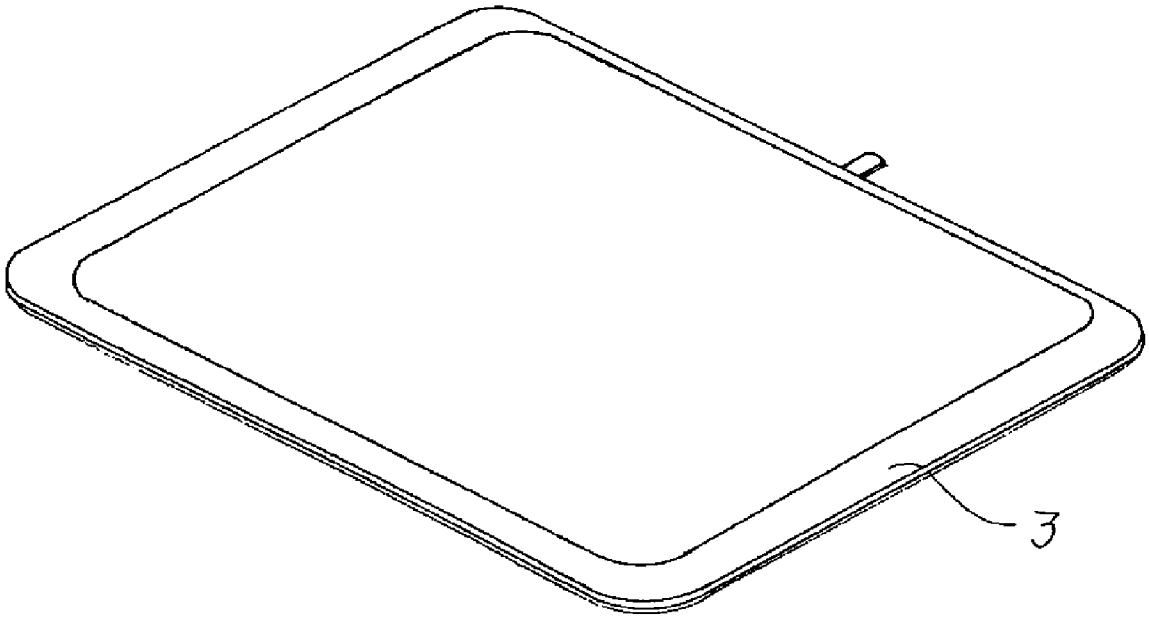
FIG. 4 is a perspective diagram showing the appearance of an antenna according to an embodiment of the present invention.

As illustrated in FIG. 4, a planar multi-directional antenna structure according to an embodiment of the present invention contains a flat and slim casing 3 within which a double-layered circuit board 4 is housed. The antenna therefore could be laid on a table top or hung on a wall surface when used. It not only takes up only limited space and but also requires very little direction adjustment.

Figure 5:
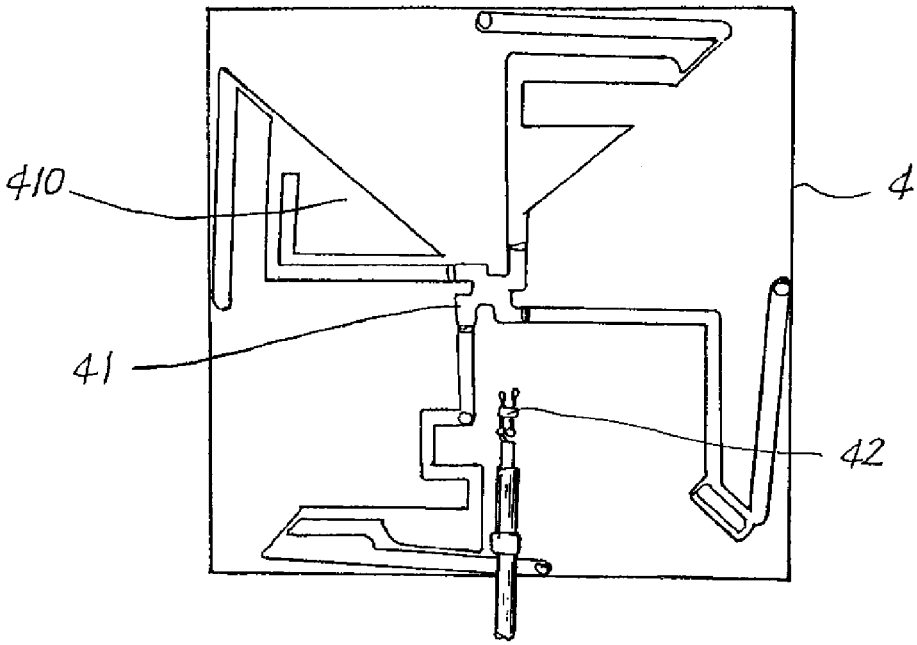
FIGS. 5 and 6 show the two major sides of a double-layered circuit board of the antenna of FIG. 4.
Figure 6:
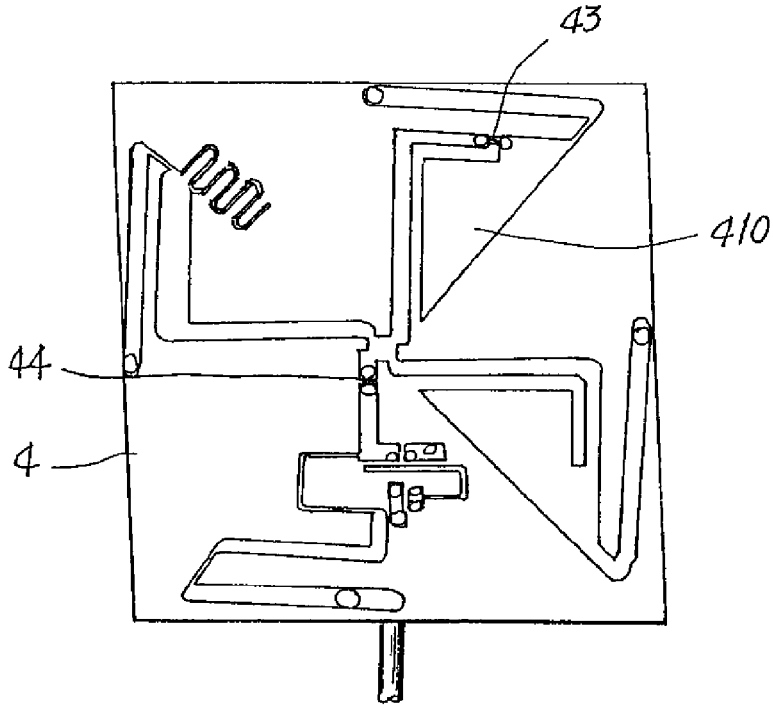

FIGS. 5 and 6 show the two major sides of the circuit board 4. As illustrated, the two major sides are patterned in a symmetrical manner. On a first major side shown in FIG. 5, a raised metallic plate 41 is positioned in the center. And, traces on both sides are routed and extended along the circumference of the circuit board 4. As such, the antenna is capable of multi-directional reception. The raised metallic plate 41 avoids the coupling effect from current converging in the center. On the other hand, the raised metallic plate 41 is also for overcoming the dielectric loss by using air. A ferrite core 42 is configured at the feeding terminal of the antenna as a means of impedance conversion, instead of using microstrip line.

As illustrated in FIG. 6, the other major side of the circuit board 4 contains a SMD (surface mount device) inductor 43 and a SMD capacitor 44 for increasing the antenna's capability of receiving signals of larger wavelength so that the antenna could receive down to the lower VHF frequencies. On both sides of the circuit board 4, the raised metallic plate 41 is connected to a number of copper foils 410 so as to increase the effective signal reception area.

Figure 7:
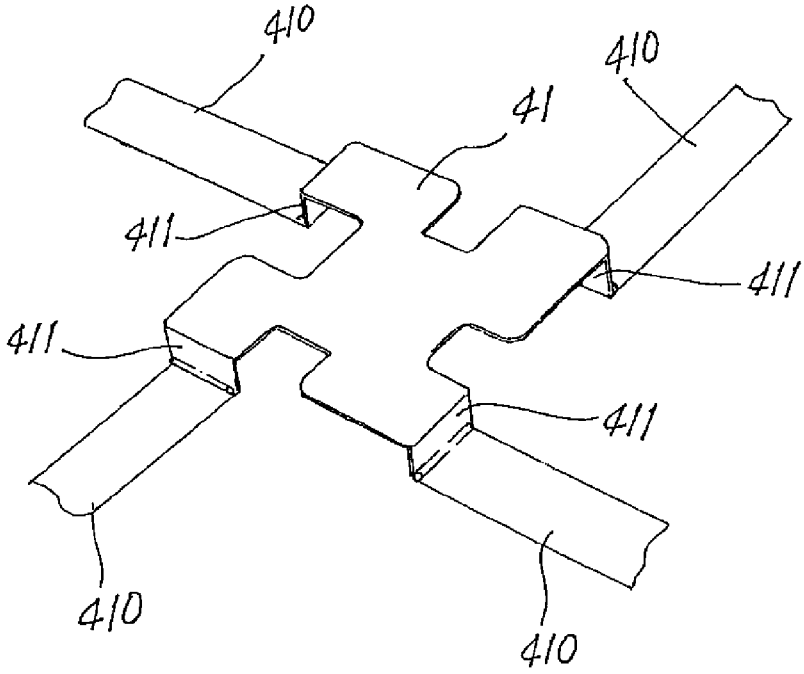
FIG. 7 is a perspective diagram showing a raised metallic plate configured on the antenna of FIG. 4.

As illustrated in FIG. 7, the raised metallic plate 41 in the center of the circuit board 4 contains a number of vertical supports 411 for keeping the metallic plate 41 at a distance from the circuit board 4 so that air is employed for reduced dielectric loss. The vertical supports 411 also connects to copper foils 410 of various shapes on both sides of the circuit board 4 so as to prevent the copper foils 410 from coupling with each other.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A planar multi-directional antenna, comprising a casing and a circuit board housed inside said casing, wherein a metallic plate is provided in the center on a first major side of said circuit board;

traces on both major sides of said circuit board are routed from said metallic plate and extended along the circumference of said circuit board;

a ferrite core is provided at a feeding terminal to said antenna for impedance conversion; and at least a SMD inductor and a SMD capacitor is provided on the other major side of said circuit board for receiving signals of larger wavelength so that said antenna is able to receive signals of lower VHF frequencies.

2. The planar multi-directional antenna according to claim 1, wherein said metallic plate is raised at a distance from said circuit board.

3. The planar multi-directional antenna according to claim 1, wherein said metallic plate is connected to a plurality of copper foils.

* * * * *